US007040076B2

(12) United States Patent
Lachenmeier et al.

(10) Patent No.: US 7,040,076 B2
(45) Date of Patent: May 9, 2006

(54) METHOD FOR PACKAGING OBJECTS

(75) Inventors: Per Lachenmeier, Sonderborg (DK); Flemming Thomsen, Garsten (DK)

(73) Assignee: Lachenmeier A/S, Sonderborg (DK)

( * ) Notice: Subject to any disclaimer, the term of this patent is extended or adjusted under 35 U.S.C. 154(b) by 0 days.

(21) Appl. No.: 09/924,528

(22) Filed: Aug. 9, 2001

(65) Prior Publication Data

US 2002/0033005 A1 Mar. 21, 2002

(30) Foreign Application Priority Data

Aug. 9, 2000 (EP) ..... 00117108

(51) Int. Cl.
*B65B 53/00* (2006.01)

(52) U.S. Cl. ..... 53/441; 53/459; 53/556; 53/567

(58) Field of Classification Search ..... 53/441, 53/556, 459, 567, 570, 464, 221, 576, 585
See application file for complete search history.

(56) References Cited

U.S. PATENT DOCUMENTS

| | | | | | |
|---|---|---|---|---|---|
| 3,902,303 | A | * | 9/1975 | King | 53/556 |
| 3,925,964 | A | * | 12/1975 | Birkenfeld et al. | 53/567 |
| 4,050,219 | A | * | 9/1977 | Higgins | 53/567 |
| 4,063,401 | A | * | 12/1977 | Higgins | 53/567 |
| 4,064,678 | A | * | 12/1977 | Grocke | 53/567 |
| 4,309,861 | A | * | 1/1982 | Karpisek | 53/556 |
| 4,473,990 | A | * | 10/1984 | Thimon | 53/567 |
| 4,724,658 | A | * | 2/1988 | Birkenfeld et al. | 53/557 |
| 5,247,783 | A | * | 9/1993 | Hannen | 53/567 |
| 5,259,170 | A | * | 11/1993 | Tolson | 53/441 |
| 5,383,326 | A | * | 1/1995 | Dean et al. | 53/556 |
| 5,595,042 | A | * | 1/1997 | Cappi et al. | 53/66 |
| 5,603,198 | A | * | 2/1997 | Rimondi et al. | 53/441 |
| 6,032,439 | A | * | 3/2000 | Birkenfeld et al. | 53/441 |

FOREIGN PATENT DOCUMENTS

| | | | |
|---|---|---|---|
| DE | 3941139 A1 | * | 6/1991 |
| DE | 39 21 190 C2 | | 1/1992 |
| DE | 3921190 | * | 1/1992 |
| DE | 43 07 287 C2 | | 7/1994 |
| DE | 4307287 | * | 7/1994 |
| EP | 0 564 971 A2 | | 10/1993 |
| EP | 0564971 | | 10/1993 |
| FR | 2230549 | * | 12/1974 |

* cited by examiner

*Primary Examiner*—Stephen F. Gerrity
(74) *Attorney, Agent, or Firm*—Birch, Stewart, Kolasch & Birch, LLP

(57) ABSTRACT

In a method for packaging an object using a hose-shaped stretch foil having laterally extending folds guided axially with respect to the stretch foil and along a length of the object, a foil hood sized to a shape of the object to be packaged is formed, which hood is reefed onto several gripper devices movable in essentially horizontal direction, of a lifting frame movable in essentially a vertical direction. The reefed foil hood is tentered in an essentially horizontal direction by the movement of the gripper device such that the tentered opening of the foil hood is larger than the contour of the object to be packed and wherein the foil hood is expanded in essentially horizontal direction. The foil hood is then pulled over the object by the essentially vertical movement of the lifting frame, wherein the foil hood is pulled off from the gripper device and is expanded in essentially vertical direction.

9 Claims, 4 Drawing Sheets

METHOD FOR PACKAGING OBJECTS

CROSS REFERENCE TO RELATED APPLICATIONS

This application claims priority from European Patent Application No. 00 117 108.1 filed Aug. 9, 2000.

BACKGROUND OF THE INVENTION

The invention relates to an apparatus and method for packaging objects using a hose-shaped stretch foil guided axially with respect to the stretch foil and along a length of an object to be packaged, e.g., such as a palletized stack of goods. Such apparatuses and methods are used in particular for packaging stacks of goods arranged on pallets in order to give protection to the stack of goods during transport against humidity and other environmental influences in case of using a foil hood. Moreover, the wrapping of the stack of goods with a foil hood or a band stock allots increased stability to the packaging unit, since the foil hood and/or band stock is stretched in horizontal and vertical direction when pulled over the stack of goods and after having been pulled over the stack of goods, exerts a pressure on the stack of goods and the pallet with tension.

From DE 39 21 190 C2 an apparatus is known for packaging objects in a hose-shaped plastic foil, in which a foil hood is reefed on gripper device arranged on a vertical frame. Subsequently, the gripper device are moved apart in horizontal direction, this stretching the foil hood in horizontal direction. Shafts adjustable with respect to the gripper device and driven are provided for on the frames and a continuously circulating band which is in contact with the outer surface of the shaft is arranged on each gripper device, Due to the rotational movement of the shaft in one direction, the foil can be pushed onto the gripper device. During the subsequent pulling-over of the foil hood over the stack of goods the foil hood can then be pulled down from the frame in controlled manner by the rotation of the shaft in opposite direction. This apparatus permits control of the vertical stretch of the foil, however, it turns out to be disadvantageous in this apparatus that the horizontal stretch of the foil on the upper surface of the objects to be packed is not sufficient. Consequently, excess stretching of the foil hood can be created when the gripper device move apart after pushing over of the foil and stretch the foil hood horizontally. Thus, in those positions of the foil hood, in which the grippers engage with the hood and expand the latter, thin portions of the foil hood are created, i.e. endangered portions in particular in the corners of the stack of goods to be packaged. This problem can be avoided in known manner in that the gripper bows have a substantial length and a broad bearing surface for the foil such that the expansion forces are distributed correspondingly. However, this solution has the disadvantage that the grippers for gripping the foil cannot be retracted to a small cross-section. Retraction to a cross-section as small as possible, however, is desired for reasons of space and is possible since the present-day foils permit high expansion even in case of low initial cross-sections of the hose. The same problems result in case of a hose stretch open on top, so-called band stock foil, cut to a suitable length.

SUMMARY OF THE INVENTION

An object of the present invention to create a method as well as an apparatus for packaging objects, which avoid the excessive stretching of the foil hood or band stock, respectively, and formation of thinned foil portions in the area of the upper surface of the good to be packed.

One of more of these and other objects are accomplished by a method for packaging an object with a hose-shaped stretch foil having laterally extending folds guided axially with respect to the foil and along a length of the object, the method including the steps of forming either a foil hood sized to the shape of the object to be packed or a band stock foil hose; reefing the foil hood or band stock, respectively, on several gripper device movable in essentially a horizontal direction and being engaged with reefing devices, of a lifting frame movable in essentially a vertical direction, wherein the reefing devices each include a respective roll being rotatably engaged with each of the gripper device; tentering the reefed foil hood or band stock, respectively, in essentially a horizontal direction by movement of the gripper device and a first rotation of the reefing devices such that the tentered opening of the foil hood or band stock, respectively, is larger than the contour of the object to be packed and wherein the foil hood or band stock, respectively, is expanded in essentially a horizontal direction; pulling-over of the foil hood or band stock, respectively, over the object by the essentially vertical movement of the lifting frame, wherein the foil hood or band stock, respectively, is pulled-off from the gripper device and is expanded in essentially a vertical direction; controlling the tension of the foil hood or band stock, respectively, during tentering in essentially a horizontal direction above the upper side of the object by controlled rolling off of the foil hood or band stock from the gripper device and the reefing devices by rotating the rolls of the reefing devices in a direction opposite to the first rotation direction of the reefing devices utilized during the reefing step.

In the method in accordance with the present inventon, for packaging objects the formed foil hood or band stock, respectively, is reefed onto several gripper device movable in essentially horizontal direction, of a lifting frame moveable in vertical direction. Subsequently, the pushed-on foil hood or band stock, respectively, is tentered by the movement of the gripper device in the essentially horizontal direction such that the tentered opening of the foil hood or band stock, respectively, is larger than the horizontal projection of the good to be packed and wherein the foil hood or band stock, respectively, is stretched in essentially horizontal direction. In a next step the foil hood or band stock, respectively, is pulled over the object by the essentially vertical movement of the lifting frame, the foil hood or band stock, respectively, being pulled off from the gripper device and being expanded in essentially vertical direction. The method in accordance with the present invention is characterized in that the tension of the foil hood or band stock, respectively, on the upper side of the stack of goods is controlled. Hereby the horizontal stretch of the foil on the upper side of the good can be adjusted to the respective practical circumstances, to the contour of the stack of goods in particular, thereby avoiding excessive stretching and formation of thinned portions in the foil and simultaneously achieving good bearing of the stretched foil in the upper area of the good to be packed in particular.

In a preferred embodiment of the method, during tentering of the foil hood or band stock, respectively, the foil partially again is pulled off from the gripper device. Thereby it is made possible that a part of the foil again is released during the horizontal stretching operation. Thereby excessive stretching in areas with thin portions in the foil are avoided, which in particular occur in positions of the foil where the gripper device are located.

In another preferred embodiment of the present invention, the pulling-off speed of the foil during tentering of the foil hood or band stock, respectively, by controlled rolling down of the foil from the gripper device is less than the speed of horizontal movement of the gripper device. Thereby it is achieved that the foil hood or band stock, respectively, continues to be stretched during tentering, however, with respect to traditional apparatuses the degree of stretching is reduced in the corner areas in which the foil is pulled over the bow-shaped grippers such that excessive stretching in horizontal direction is avoided.

In order to achieve a good stretch in vertical direction during pulling-over of the foil hood or band stock, respectively, over the object on the pallet, in a further preferred embodiment the pulling-off speed of the foil during pulling-over is lower than the vertical speed of the lifting frame.

In a particularly preferred embodiment of the method in accordance with the present invention reefing or pulling-off of the foil hood or band stock, respectively, during reefing or tentering and/or pulling-off of the foil hood or band stock, respectively, during pulling-over is caused by the movement of rolls, the outer surfaces of the rolls shifting the portions of the foil hood or band stock, respectively, pushed onto the gripper device. Thereby, the reefing or pulling-off speed, respectively, of the foil hood or band stock, respectively, can be accurately controlled by the control of the speed of the rolls.

In a further embodiment the lower end of the foil hood or band stock, respectively, in the end phase of pulling-over is held for creating a maximum vertical stretch and an understretch such that the lower end of the foil hood or band stock, respectively, fixedly bears on the bottom side of the stack of goods on pallet. In a preferred embodiment holding of the foil hood or band stock, respectively, can be effected by the above-described rolls which press the foil hood or band stock, respectively, to the gripper device. However, also other device for holding the foil hood or band stock, respectively, can be provided for.

The apparatus in accordance with the present invention for packaging objects with a stretch foil includes a lifting frame movable in essentially vertical direction, for pulling-over the foil hood or band stock, respectively, over the stack of goods as well as gripper device provided for an the lifting frame, for gripping and expanding the foil hood or band stock, respectively, in essentially horizontal direction. Furthermore, on the gripper device reefing device for reefing and pulling-off the foil hood or band stock, respectively, from the gripper device are provided for. The reefing device are characterized in that they comprise control device for controlling expansion of the foil hood or band stock, respectively, in the area of the upper side of the stack of goods, whereby a desired horizontal stretch of the foil can be adjusted and excessive stretching is avoided.

In a preferred embodiment the reefing device permit the partial pulling-off of the foil hood or band stock, respectively, from the gripper device during the essentially horizontal movement of the gripper device. Thereby, the horizontal stretch of the foil is reduced and thin positions in the foil, in particular in positions where the foil runs over the bow-shaped sections at the upper end of the grippers, are avoided.

In a preferred embodiment the control device can control the pulling-off speed during the essentially horizontal movement of the gripper device and/or the vertical movement of the lifting frame. The control therein is effected in advantageous manner such that the pulling-off speed during the essentially horizontal movement of the gripper device is lower than the speed of the gripper device and/or that the pulling-off speed during the essentially vertical movement of the lifting frame is lower than the speed of the lifting frame. Hereby a certain degree of expansion of the foil hood or band stock, respectively, in vertical and horizontal directions is achieved.

In a further embodiment of the apparatus in accordance with the present invention the reefing device comprise at least one roll which can be brought to bear on the lifting frame and rolls up or rolls of the foil hood or band stock, respectively, onto or from the gripper device.

In order to achieve maximum understretch of the foil hood or band stock, respectively, in a further embodiment a holding device is provided for at each reefing device, for holding the foil at the gripper device during the pulling-over phase. The holding device in an embodiment of the apparatus can be formed by the above-described rolls that press the foil hood or band stock, respectively, against the gripper device during the pulling-over end phase.

BRIEF DESCRIPTION OF DRAWINGS

Further features, advantages and details of the present invention result from the following detailed description of a preferred embodiment with reference to the attached drawing, wherein.

DETAILED DESCRIPTION OF PREFERRED EMBODIMENT

Figure 1:
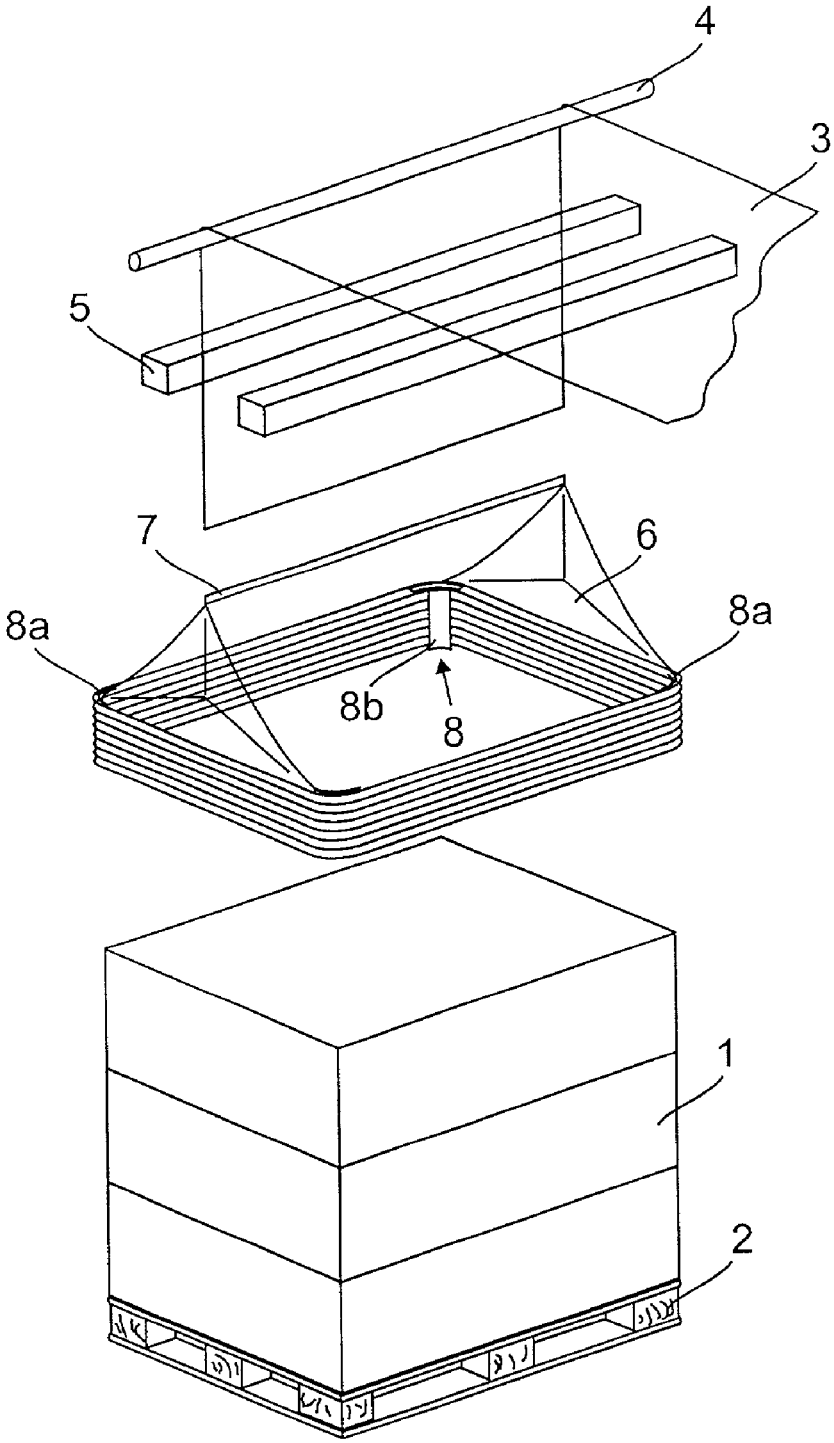
FIG. 1 shows a perspective view of the essential parts of an apparatus for packaging objects in accordance with an embodiment of the present invention.

The apparatus shown in FIG. 1, for packaging objects 1 comprises a supply roll not shown, for a folded foil hose 3 which is unwound from the supply roll and fed to a central packaging unit. The packaging unit comprises a frame that is moved in vertical direction over the stack of goods 1 for packaging the objects. However, only the components of the packaging unit relevant for the invention are shown for better elucidation.

As can be seen from FIG. 1, the foil hose 3 is guided over a deflection rod 4 vertically in downward direction to a welding and cutting device 5 when a foil hood is to be formed. In the welding and cutting device the foil hose 3 is closed by welding at a desired length and is cut off and the end of the foil hose opposite to the welded end is reefed onto the four gripper device 8 provided for on the frame and subsequently is tensioned in horizontal direction by horizontal movement of the gripper device such that an opened foil hood 6 is created. The gripper device shown in FIG. 1 includes bow-like frame sections 8*a* and bow supports 8*b*. The bow-like frame sections 8*a* and the bow supports 8*b* are formed C-shaped and thus pre-define the corners of the foil hood. If creation of a foil hood closed on its upper side is not intended, the welding device can be done without and a hose piece (band stock) is cut to a given length. In the following, however, a foil hood is talked about.

FIGS. 2A to 2F show the steps of the method in accordance with the present invention, for packaging the stack of goods 1 with the foil hood 6, wherein in the figures two gripper devices 8 are shown respectively. As can be seen from the figures, a reefing device 9 is arranged on the gripper device respectively, which pushes the foil hood onto the respective gripper device or pulls it off therefrom. The reefing device 9 includes a roll 10 as well as a drive 11. The reefing device is fixed on a support 12 that again is arranged in a guide 14 and is horizontally shiftable. The bow piece of the gripper device 8 is fixed to an arm 13. The arm also is arranged in the guide 14 and is shiftable in horizontal direction.

Figure 2A:
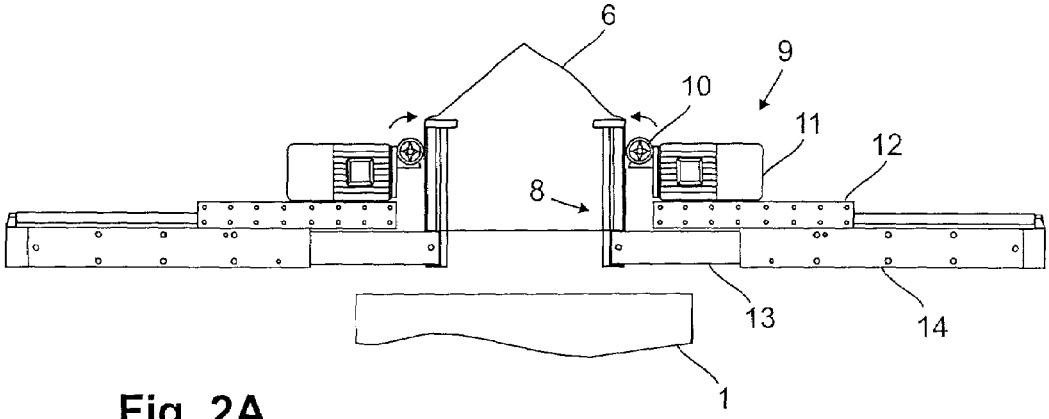
FIGS. 2A to 2F show the individual steps of an embodiment of the method in accordance with the present invention.
Figure 2B:
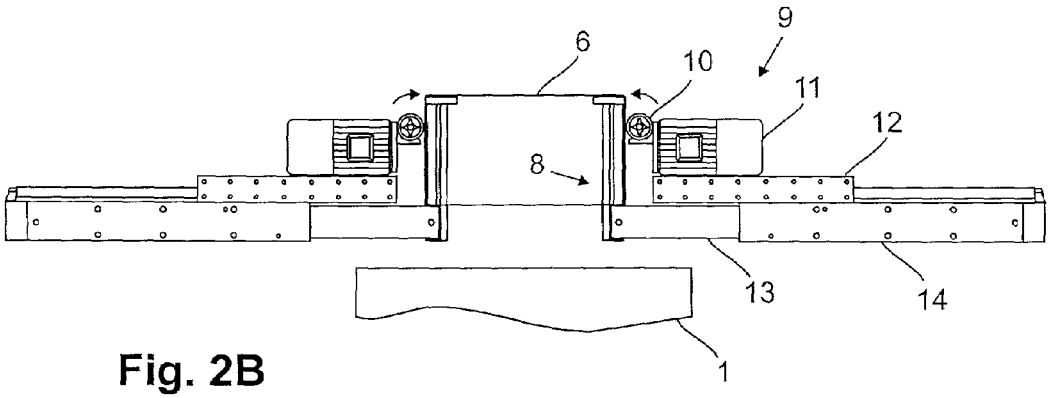
Figure 2C:
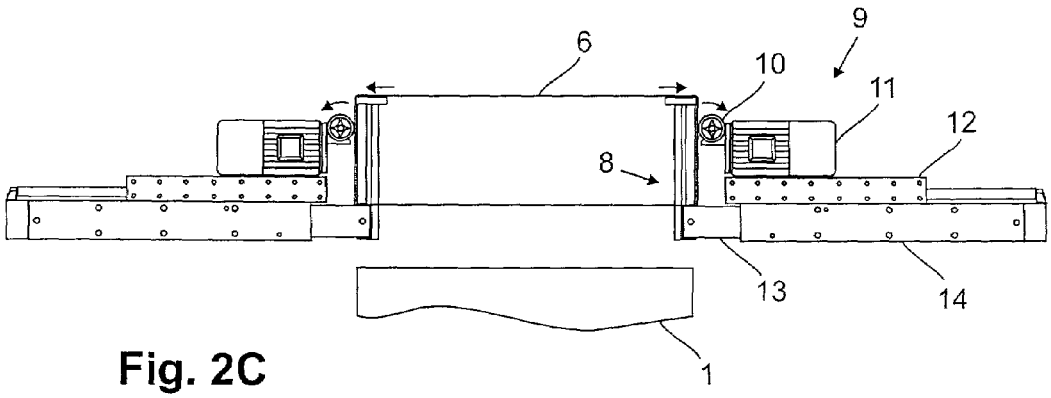
Figure 2D:
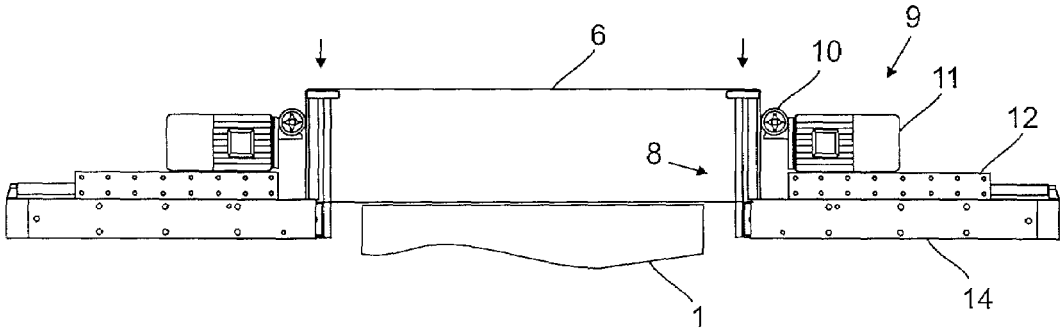

As is shown in FIG. 2A, after welding together and cutting off of the foil hood 6 reefing of the latter onto the gripper device 8 is carried out. For this purpose the arm 13 is moved into a position in which the cross section of the frame is smaller than the contour of the stack of goods. In addition, the outer surfaces of the rolls 10 come into contact with the outsides of the foil hood. By rotating the roll of the left-hand gripper device in a clockwise direction and rotating the roll of the right-hand gripper device in counterclockwise direction (as indicated by the arrows in FIG. 2A) now the foil hood can be reefed onto the bow-like frame section of the gripper device 8. In FIG. 2B the condition of the foil hood after reefing onto the gripper device 8 is shown.

In order to now stretch the foil hood 6 in horizontal direction, the gripper devices 8 are moved in horizontal direction to the right-hand and/or left-hand sides, respectively. This method step can be seen from FIG. 2C, wherein the movement of the gripper device is indicated by arrows. For avoiding that the foil hood on the corners or the gripper action area is exposed to such strong expansion forces that thin portions are created in the foil which might cause damage of the foil, both rolls 10 of the pushing-on device 9 are moved into the direction opposite to that of the preceding method step, this permitting slow rolling-off of the foil hood during the horizontal stretching operation. Herein it is essential that the speed of the rolls is adjusted such that the rolling-off speed from the gripper device is less than the horizontal speed of the gripper device since otherwise the desired stretch could not be made possible. In total it is achieved by this method step that the horizontal stretch is reduced in controlled manner as controlled to the traditional apparatuses.

After the horizontal stretch having been carried out now the frame is moved vertically in downward direction, wherein the rolls 10 do not carry out a rotational movement until the foil hood touches the upper end of the stack of goods. The method step can be seen from FIG. 2D.

Figure 2E:
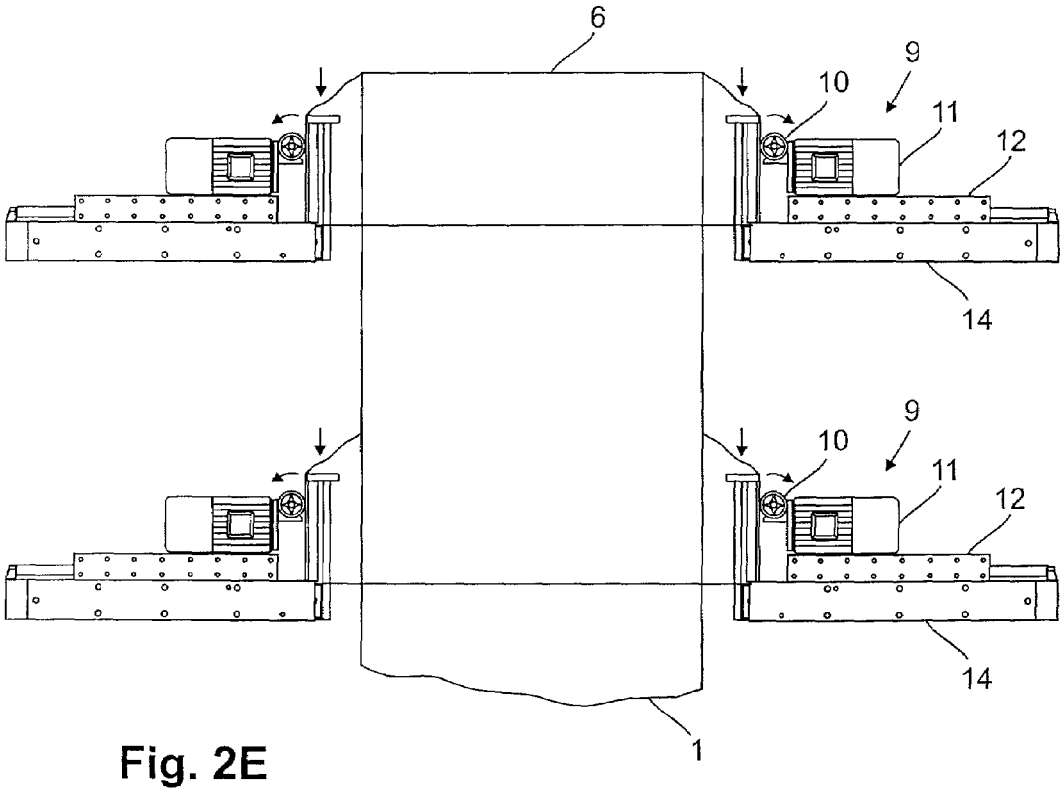

In FIG. 2E two method steps during pulling-over of the foil hood over the stack of goods are shown, wherein the foil hood is in contact with the stack of goods. As soon as the foil hood touches the stack of goods, beside the vertical movement of the frame a rotational movement of the rolls 10 of the gripper device 8 starts, wherein the roll of the left-hand gripper device rotates in a counterclockwise direction and the roll of the left-hand gripper device moves in a clockwise direction. By the rotational movement of the rolls rolling-down of the foil hood from the gripper device is controlled and thereby a desired vertical stretch of the foil hood is achieved. The speed of the rolls therein is adjusted such that the rolling-down speed of the foil hood from the gripper device is lower than the vertical speed of the lifting frame since otherwise the desired vertical stretch could not be produced.

Figure 2F:
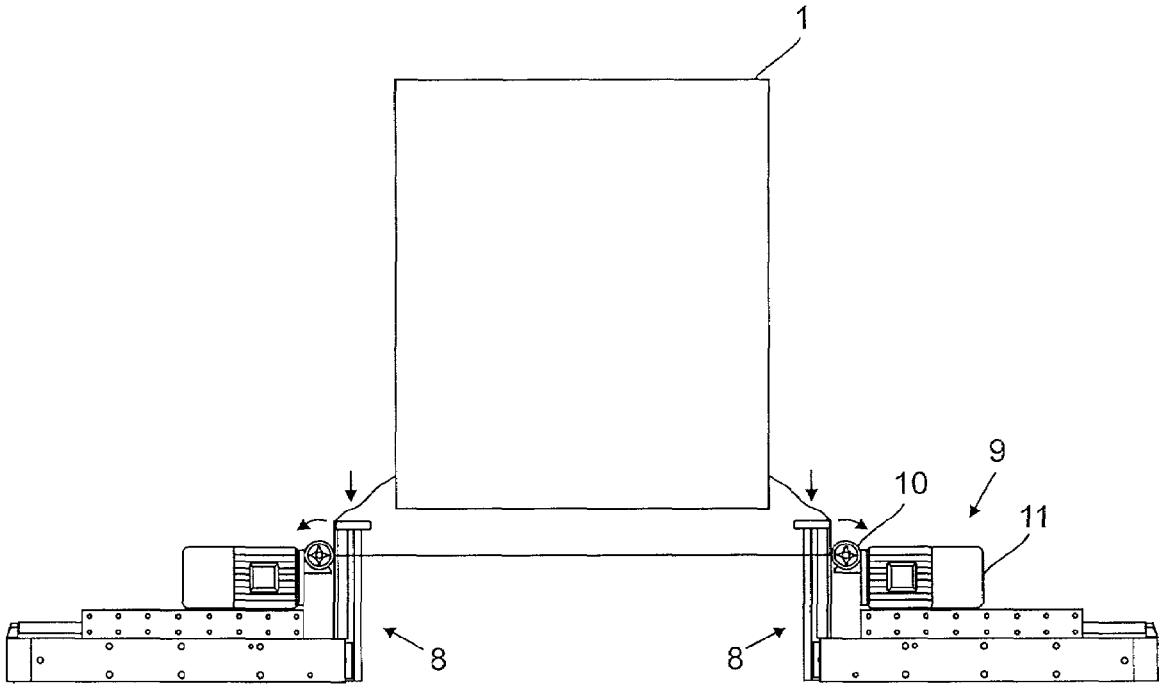

FIG. 2F shows the method step finishing the pulling-over operation. After the frame with the respective gripper device is located below the lower end of the stack of goods and the foil hood is rolled down from the respective gripper device to a high degree, the lower end of the foil hood is held on the gripper device in order to thus permit maximum vertical stretch as well as an understretch. Thereby fixed bearing of the lower end of the foil hood on the stack of goods after sliding down from the gripper device is rendered possible.

Therefore, it also is conceivable that the gripper device in case of pressed-on rolls moved towards one another until under the pallet for thereafter completely releasing the foil that already partly moved under the pallet. During the movement of the gripper device in inward direction under the load the foil under the effect of the rolls is released with a lower speed than the speed of the horizontally moving gripper device.

What is claimed is:

1. A method for packaging an object with a hose-shaped stretch foil having laterally extending folds guided axially with respect to the foil and along a length of the object, said method including the steps of:

forming either a foil hood sized to the length of said object to be packed or a band stock foil hose;

reefing said foil hood or band stock, respectively, on several gripper devices movable in essentially a horizontal direction and being engaged with reefing devices, of a lifting frame movable in essentially a vertical direction, wherein said reefing devices each include a respective roll being rotatably engaged with each of said gripper devices;

tentering said reefed foil hood or band stock, respectively, in essentially a horizontal direction by movement of said gripper devices and a first rotation of said reefing devices such that said tentered opening of said foil hood or band stock, respectively, is larger than the contour of said object to be packed and wherein said foil hood or band stock, respectively, is expanded in essentially a horizontal direction;

pulling-over of said foil hood or band stock, respectively, over said object by the essentially vertical movement of said lifting frame, wherein said foil hood or band stock, respectively, is pulled-off from said gripper devices and is expanded in essentially a vertical direction;

controlling the tension of said foil hood or band stock, respectively, during tentering in essentially a horizontal direction above the upper side of said object by controlled rolling off of the foil hood or band stock from said gripper devices and said reefing devices by rotating the rolls of said reefing devices in a direction opposite to the first rotation direction of the reefing devices utilized during said reefing step.

2. The method as defined in claim 1, wherein said foil hood or band stock, respectively, is partly pulled off from said gripper devices during tentering.

3. The method as defined in claim 2, wherein a pulling-off speed of said foil hood or band stock, respectively, during tentering is lower than a speed of the essentially horizontal movement of said gripper devices.

4. The method as defined in claim 1, wherein a pulling-off speed of said foil hood or band stock, respectively, during pulling-over of said foil hood is lower than a speed of the essentially vertical movement of said lifting frame.

5. The method as defined in claim 1, wherein said reefing or pulling-off, respectively, of said foil hood or band stock, respectively, during reefing or tentering, respectively, or pulling-off of said foil hood during pulling-over is effected by the movement of the rolls, wherein the outer surfaces of said rolls shift said foil hood pushed onto said gripper devices.

6. The method as defined in claim 1, wherein said foil hood or band stock, respectively, is held on said gripper devices during an end phase of said pulling-over.

7. The method as defined in claim 6, wherein said holding of said foil hood or band stock, respectively, is effected by the rolls which press said foil hood against said gripper devices during said tentering process.

8. The method as defined in claim 1, wherein said reefing or pulling-off, respectively, of said foil hood or band stock, respectively, during reefing and tentering, respectively, and pulling-off of said foil hood during pulling-over is effected by the movement of the rolls, wherein the outer surfaces of said rolls shift said foil hood pushed onto said gripper devices.

9. The method as defined in claim 1, wherein the object is a palletized stack of goods.

* * * * *